US007610774B2

(12) United States Patent
Anderson et al.

(10) Patent No.: US 7,610,774 B2
(45) Date of Patent: Nov. 3, 2009

(54) REFRIGERATOR DOOR WITH CAN AND BOTTLE HOLDER

(75) Inventors: Troy M. Anderson, Marion, IA (US); Scott W. Leimkuehler, Swisher, IA (US); Joseph M. Nurre, Marion, IA (US); Lester J. Ott, Swisher, IA (US); Doug M. Roush, Des Moines, IA (US); Eric K. Silbaugh, Cedar Rapids, IA (US); Todd J. Tunzi, Amana, IA (US)

(73) Assignee: Maytag Corporation, Benton Harbor, MI (US)

( * ) Notice: Subject to any disclaimer, the term of this patent is extended or adjusted under 35 U.S.C. 154(b) by 587 days.

(21) Appl. No.: 11/331,870

(22) Filed: Jan. 13, 2006

(65) Prior Publication Data

US 2006/0260352 A1 Nov. 23, 2006

Related U.S. Application Data

(63) Continuation-in-part of application No. 11/139,237, filed on May 27, 2005, now Pat. No. 7,337,620, which is a continuation-in-part of application No. 11/131,701, filed on May 18, 2005, now Pat. No. 7,284,390.

(51) Int. Cl.
*F25D 11/00* (2006.01)

(52) U.S. Cl. ..... 62/440; 62/457.4; 49/501; 211/74; 312/405.1

(58) Field of Classification Search ..... 62/457.4–457.6, 62/440–441; 312/405.1; 211/74, 90.01; 49/501

See application file for complete search history.

(56) References Cited

U.S. PATENT DOCUMENTS

| | | | | |
|---|---|---|---|---|
| 2,903,315 | A * | 9/1959 | Schory et al. | 312/405.1 |
| 3,220,558 | A * | 11/1965 | Olsson | 211/74 |
| 3,401,996 | A * | 9/1968 | Rembold et al. | 312/405.1 |
| 4,531,381 | A * | 7/1985 | Toro et al. | 62/372 |
| 5,567,029 | A * | 10/1996 | Haenisch et al. | 312/405.1 |
| 6,360,558 | B1 * | 3/2002 | Woog | 62/457.5 |
| 6,481,014 | B1 * | 11/2002 | Banks et al. | 220/592.17 |
| 6,571,967 | B2 * | 6/2003 | Belokin et al. | 211/71.01 |
| 6,640,581 | B1 * | 11/2003 | Choi | 62/440 |
| 7,080,744 | B2 * | 7/2006 | Robertson | 211/75 |
| 7,269,970 | B2 * | 9/2007 | Robertson | 62/457.5 |
| 2003/0080078 | A1 * | 5/2003 | Belokin et al. | 211/88.01 |
| 2004/0012314 | A1 * | 1/2004 | Hay et al. | 312/405.1 |

* cited by examiner

*Primary Examiner*—William E Tapolcai
(74) *Attorney, Agent, or Firm*—Kirk W. Goodwin; McKee, Voorhees & Sease PLC

(57) ABSTRACT

A refrigerator is provided with a fresh food compartment and a door for the fresh food compartment having an organizer with a plurality of openings formed in the door for holding individual food and beverage containers. The openings include a cradle for supporting a sidewall of each container so as to hold the container in an inclined orientation. The openings are vertically aligned adjacent the ice dispenser chute of the door.

15 Claims, 9 Drawing Sheets

REFRIGERATOR DOOR WITH CAN AND BOTTLE HOLDER

CROSS-REFERENCE TO RELATED APPLICATIONS

This application is a continuation-in-part application of U.S. patent application Ser. No. 11/139,237, filed May 27, 2005, entitled INSULATED ICE COMPARTMENT FOR BOTTOM MOUNT REFRIGERATOR, which is a continuation-in-part of and U.S. application Ser. No. 11/131,701, filed May 18, 2005, entitled REFRIGERATOR WITH INTERMEDIATE TEMPERATURE ICEMAKING COMPARTMENT, both of which are herein incorporated by reference in their entirety.

BACKGROUND OF THE INVENTION

Household refrigerators generally come in three structural styles: (1) a side-by-side model wherein the freezer and refrigerator compartments are side by side; (2) a top mount model wherein the freezer compartment is located above the refrigerator compartment; and (3) a bottom mount model wherein the freezer compartment is mounted below the refrigerator compartment. An icemaker is normally provided in the freezer compartment of all three models. A door mounted ice dispenser is often provided in a side-by-side refrigerator and in a top mount refrigerator so that a person can add ice to a glass without opening the freezer or refrigerator door. However, a door mounted ice dispenser normally is not been provided in bottom mount refrigerators, since the freezer door is too low, and there are difficulties in transporting ice from the freezer compartment to the refrigerator compartment which precludes a dispenser in the refrigerator compartment door. However, it is desirable to have an ice dispenser in the refrigerator compartment of a bottom mount refrigerator.

In prior art refrigerators wherein the freezer door includes an ice dispenser, the interior door liner includes a chute which receives ice from the ice storage bin in the ice making compartment. The chute typically occupies a large area of the interior of the freezer door, such that there is no room for additional storage structure in the door. Ice dispensers have not been provided in the fresh food door of refrigerators, since ice is typically made in the freezer compartment. Freezer and fresh food doors have both utilized shelves and buckets for organizing various food and drink items, though such storage organizers are not normally for individual containers.

Therefore, a primary objective of the present invention is the provision of an improved refrigerator door for a fresh food compartment having a can and bottle holder therein.

A further objective of the present invention is the provision of a refrigerator having a fresh food door with a plurality of openings formed therein to hold individual containers.

Another objective of the present invention is the provision of a refrigerator door having both an ice dispenser and a beverage container.

Still another objective of the present invention is the provision of a bottom mount refrigerator with a lower freezer compartment and an upper refrigerator compartment, with an ice dispenser and a container storage area in the fresh food door.

Yet another objective of the present invention is the provision of a refrigerator with a fresh food compartment door having openings formed therein to hold individual cans, bottles, and other food and beverage containers.

These and other objectives will become apparent from the following description of the invention.

SUMMARY OF THE INVENTION

The refrigerator of the present invention has a fresh food compartment with at least one door. The fresh food door includes an ice dispenser, as well as a plurality of openings or cavities formed in the door for holding individual beverage and food containers, such as cans and bottles. The openings include a lower lip or cradle to support a sidewall of the container, and thereby support the container in an inclined orientation. The openings are vertically aligned in the door. The openings may be formed in the primary liner of the door, or may be formed in a secondary liner attached to the primary liner.

DETAILED DESCRIPTION OF THE PREFERRED EMBODIMENT

Figure 1:
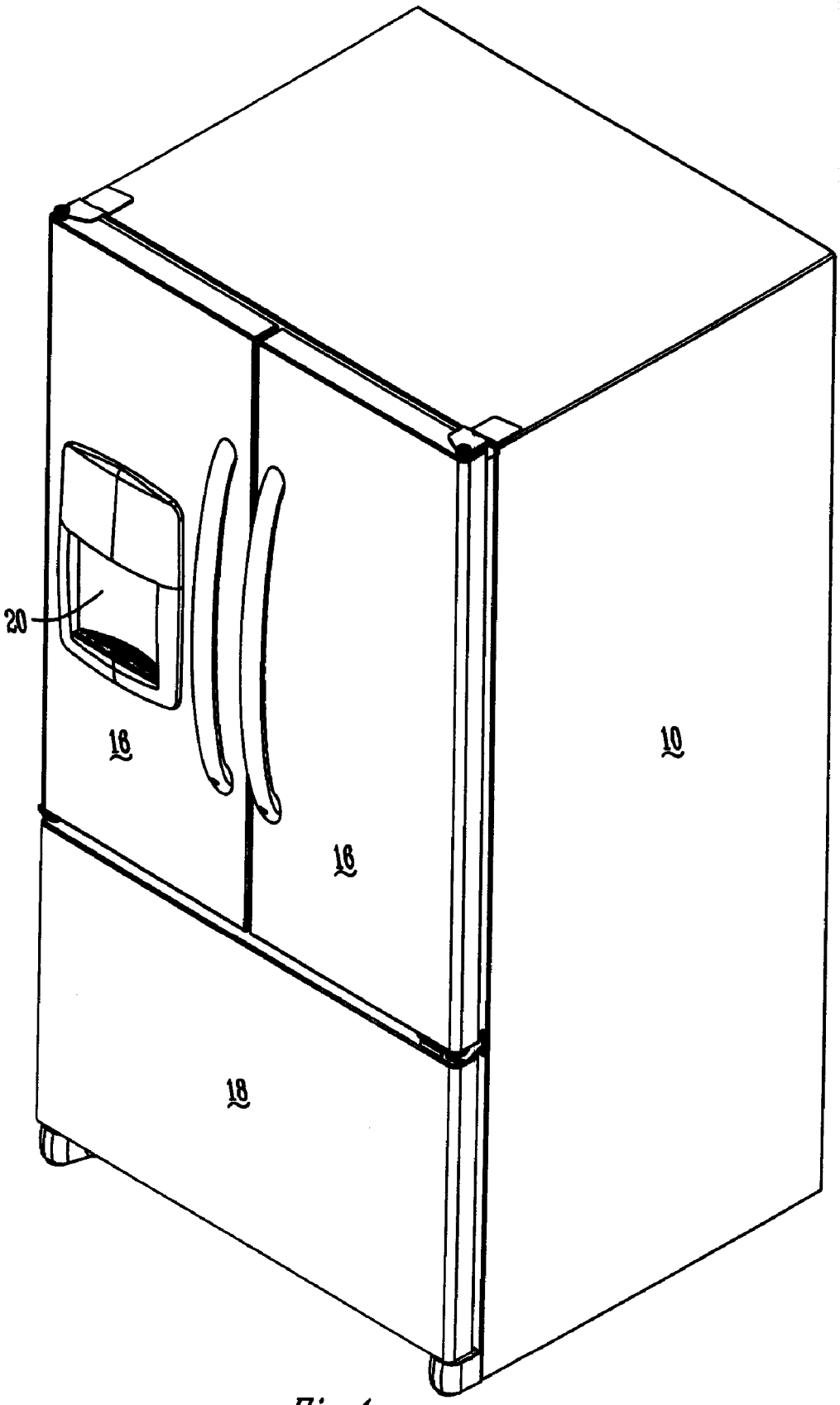
FIG. 1 is a perspective view of a bottom mount refrigerator according to the present invention.
Figure 2A:
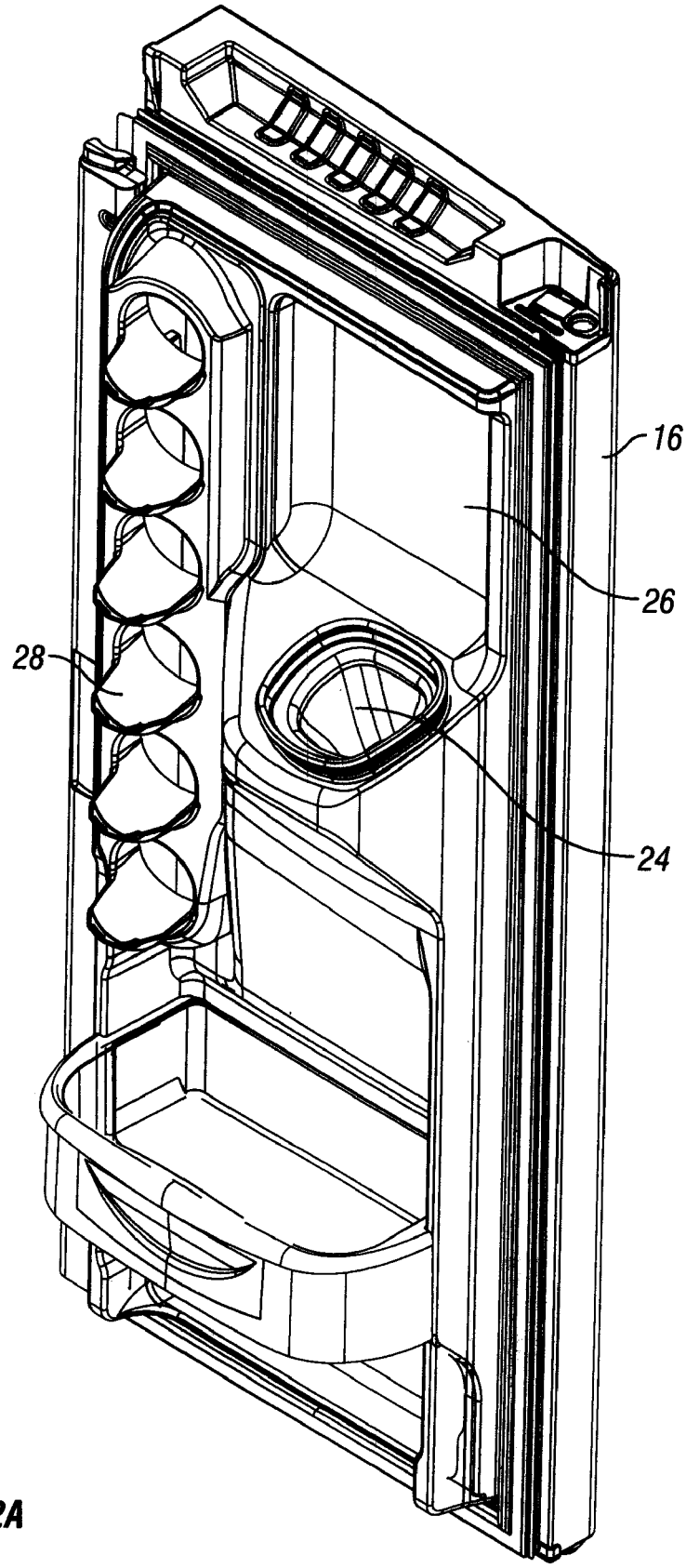
FIGS. 2A and 2B are perspective views of the fresh food door with the can and bottle holder of the present invention.
Figure 2B:
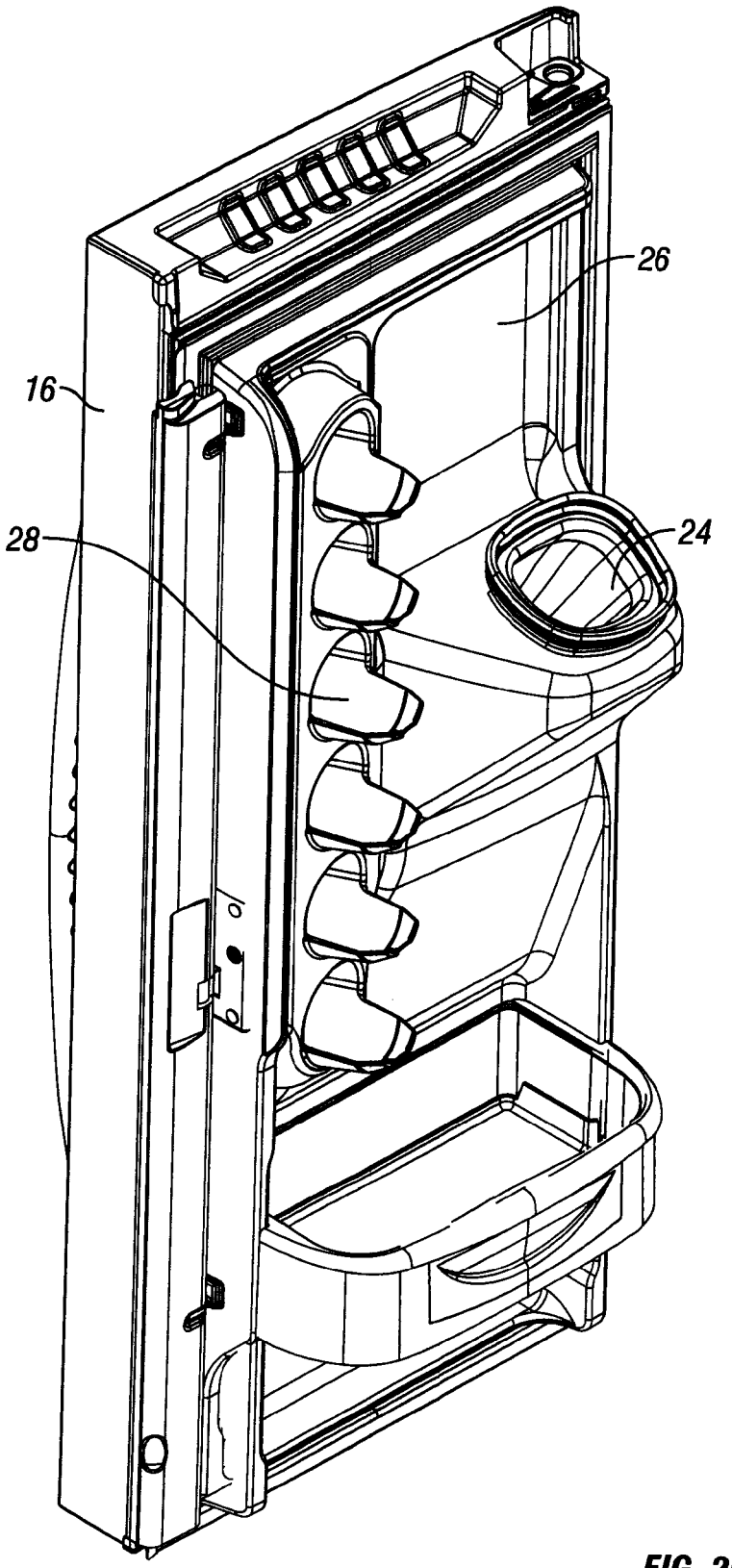
Figure 3:
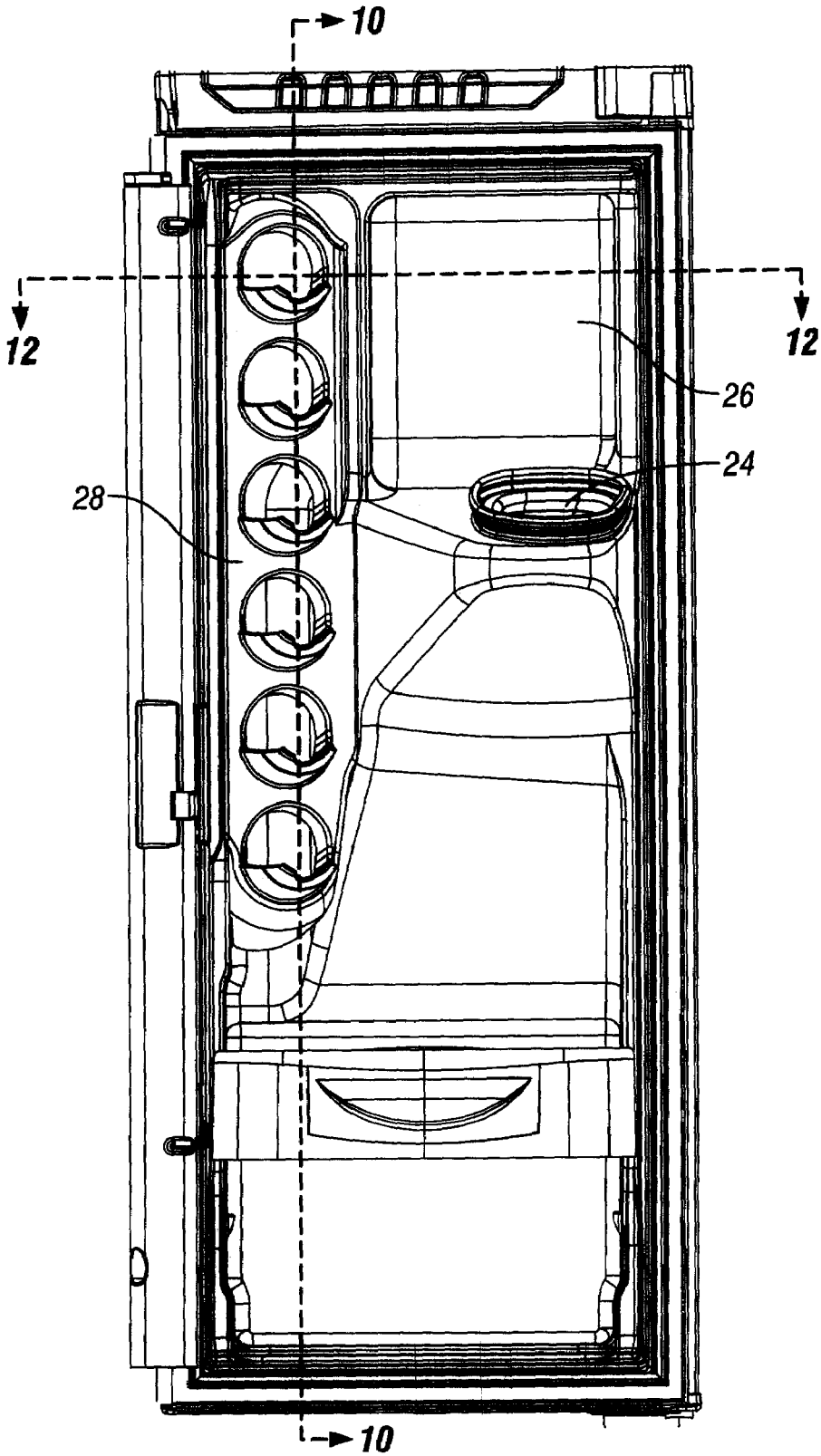
FIG. 3 is a front elevation view of the door shown in FIGS. 2A and 2B.
Figure 4:
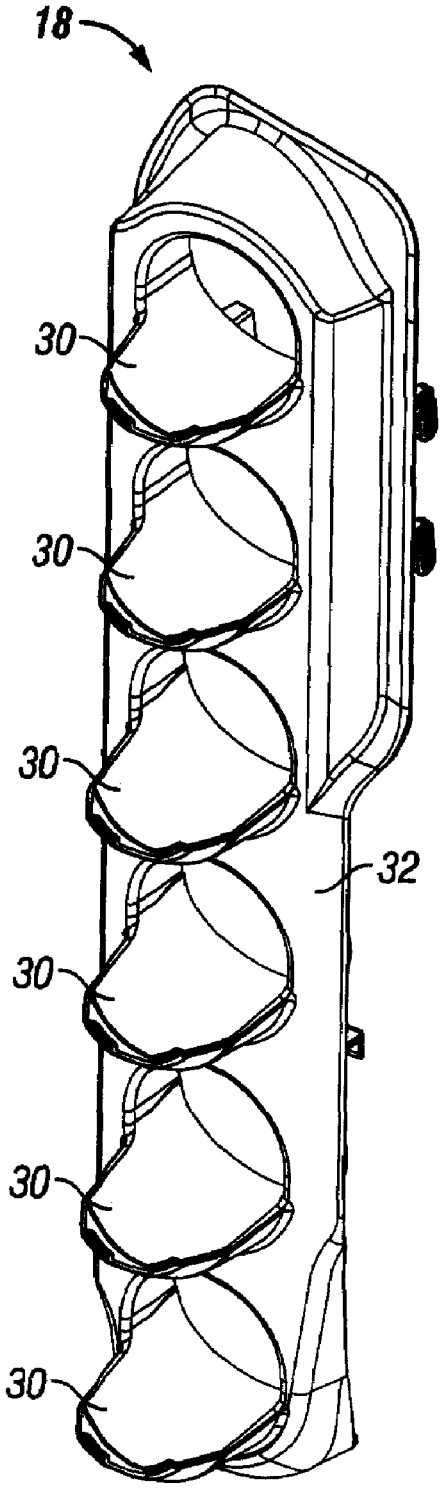
FIGS. 4 and 5 are perspective views of a container holder component of the present invention.
Figure 5:
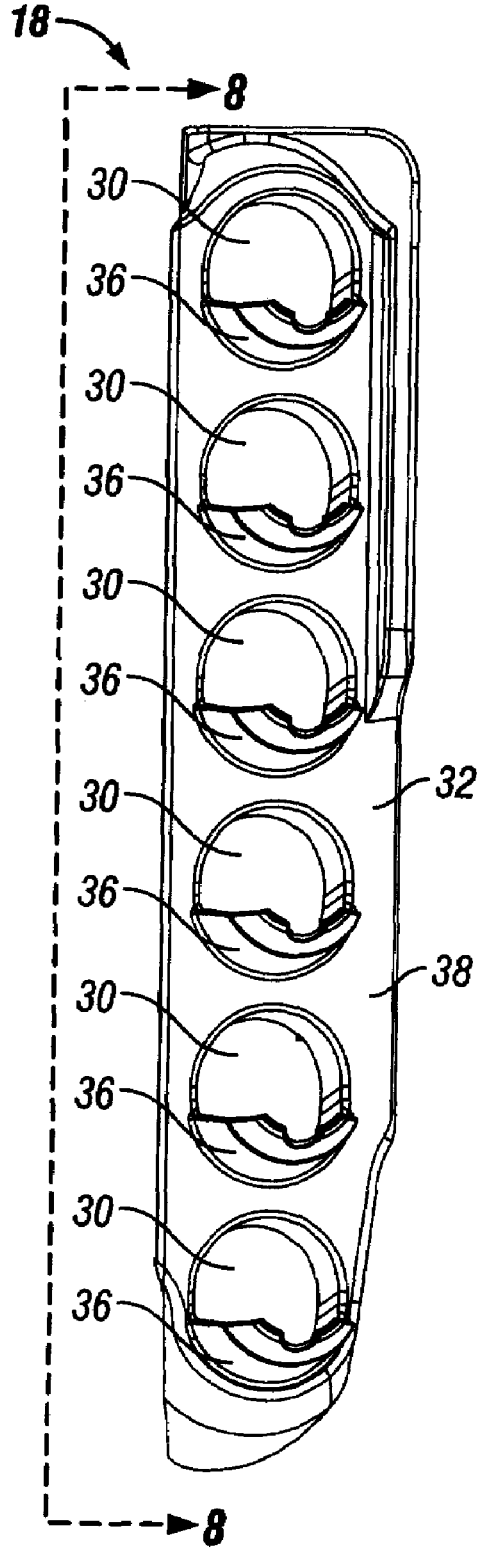

A bottom mount refrigerator is generally designated in the drawings by the reference numeral 10. The refrigerator 10 includes a refrigerator or fresh food compartment 12 and a freezer compartment 14. Doors 16 are provided for the refrigerator compartment or fresh food compartment 12, and a door 18 is provided for the freezer compartment 14. One of the doors 16 includes an ice dispenser 20 which may also include a water dispenser. An ice compartment 22 is provided in an upper corner of the fresh food compartment 12. An ice chute 24 is formed in the door liner 26 of the door 16 to provide communication between an ice storage bin (not shown) in the ice compartment 22 and the ice dispenser 20 in the door 16.

The present invention is directed towards an organizer 28 in the door 16 for holding cans, bottles, jars, and other food and beverage containers. The organizer 28 preferably includes a plurality of openings or cavities 30 each being adapted to hold an individual container. The openings 30 are arranged one above another in a substantially vertical alignment, adjacent the ice chute 24.

In the preferred embodiment, the openings are formed in an attachment component 32 which mounts to the primary door liner 26. The attachment piece 32 can be mounted to the primary liner 26 in any convenient manner, such as hooks 34 which are received in corresponding openings in the primary liner 26. Alternatively, the openings 30 may be integrally molded or formed in the primary liner 26.

Figure 6:
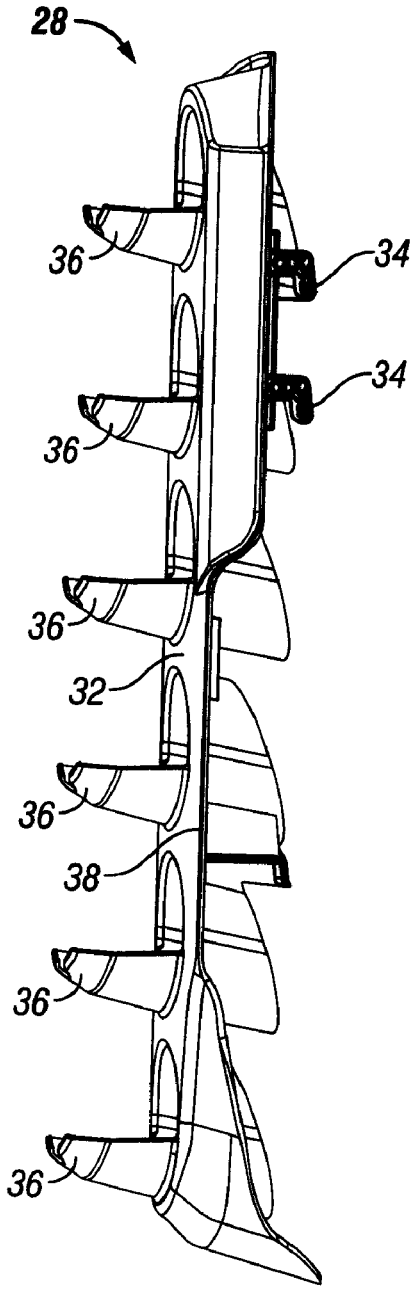
FIGS. 6 and 7 are opposite side elevation views of the container holder component.
Figure 7:
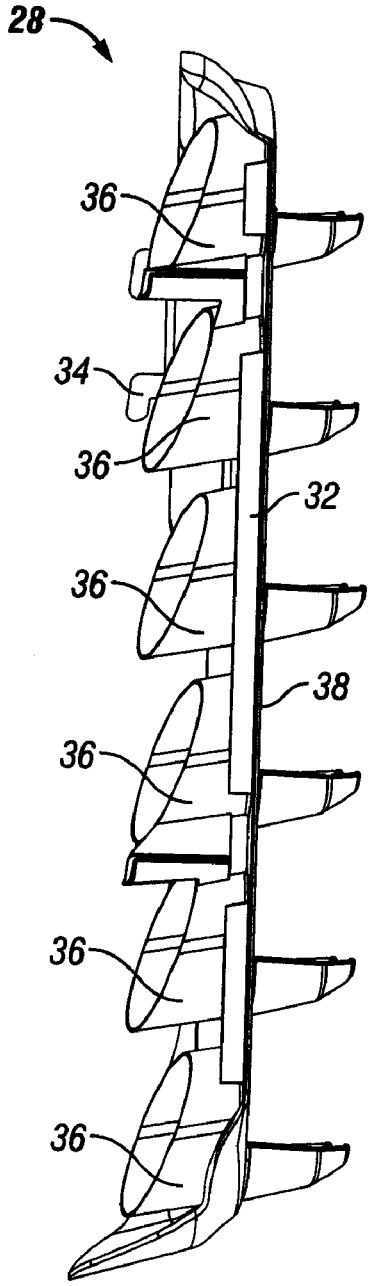
Figure 8:
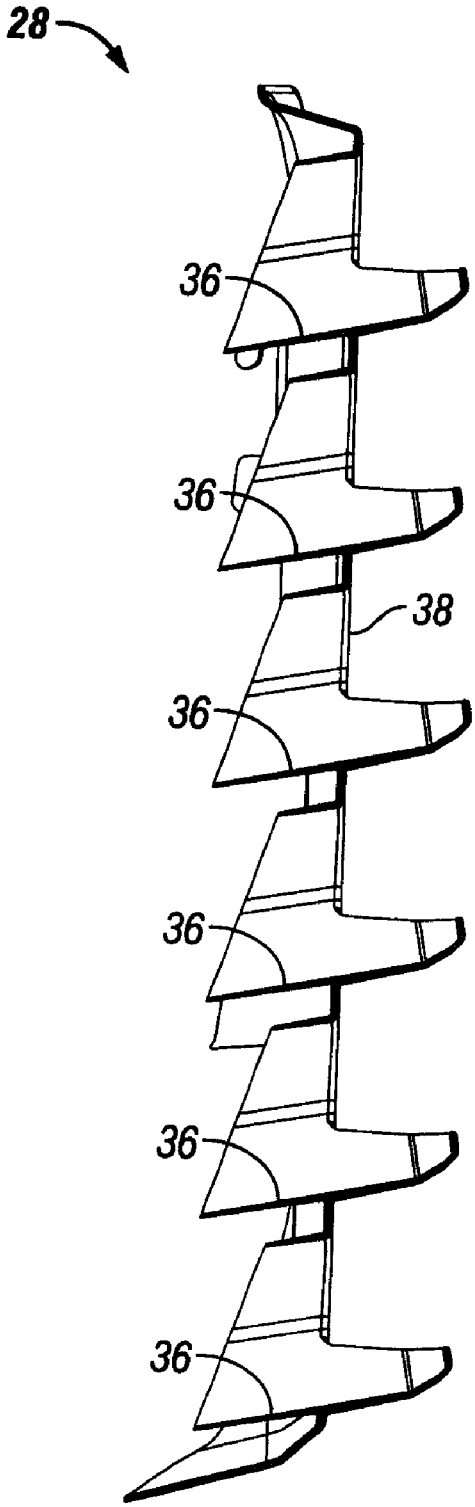
FIG. 8 is a view taken along lines 8-8 of FIG. 5.
Figure 9:
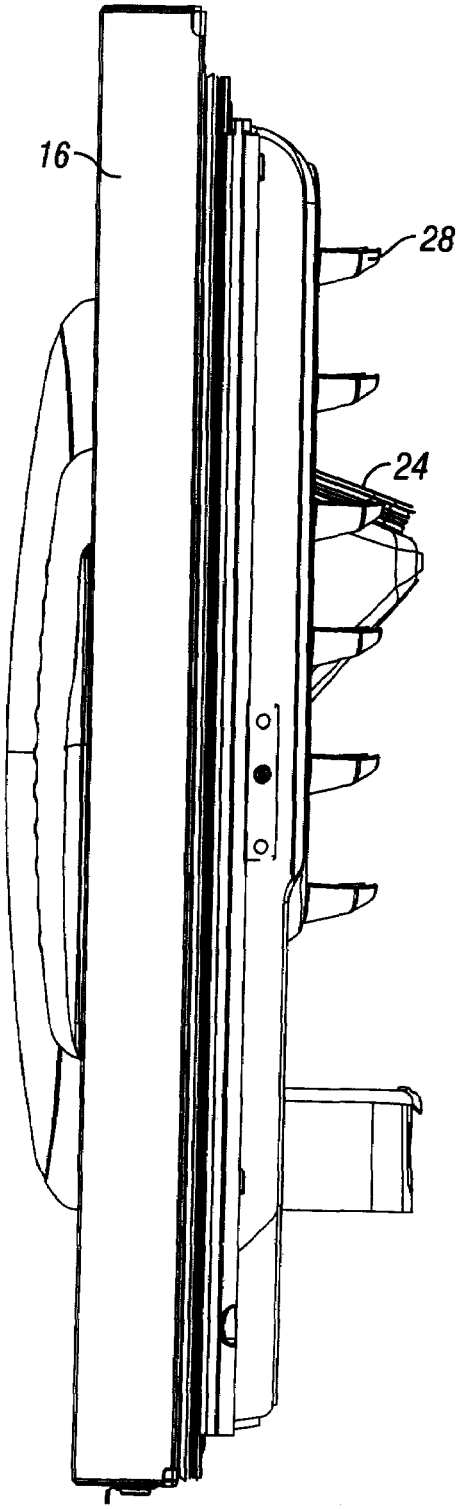
FIG. 9 is a side elevation view of the door of FIGS. 2A and 2B.
Figure 10:
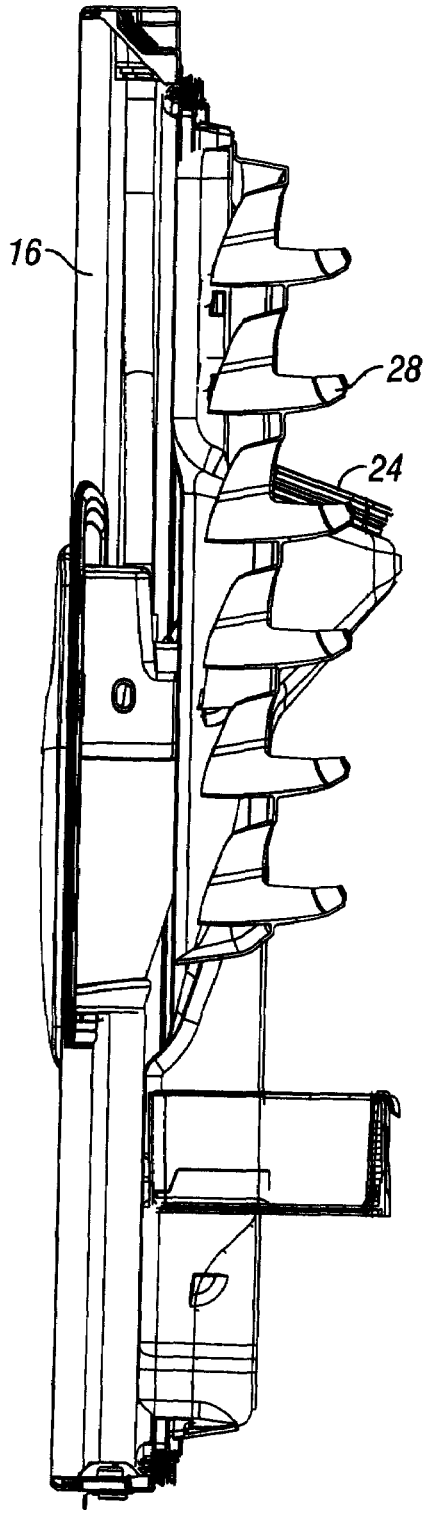
FIG. 10 is a sectional view taken along lines 10-10 of FIG. 3.
Figure 11:
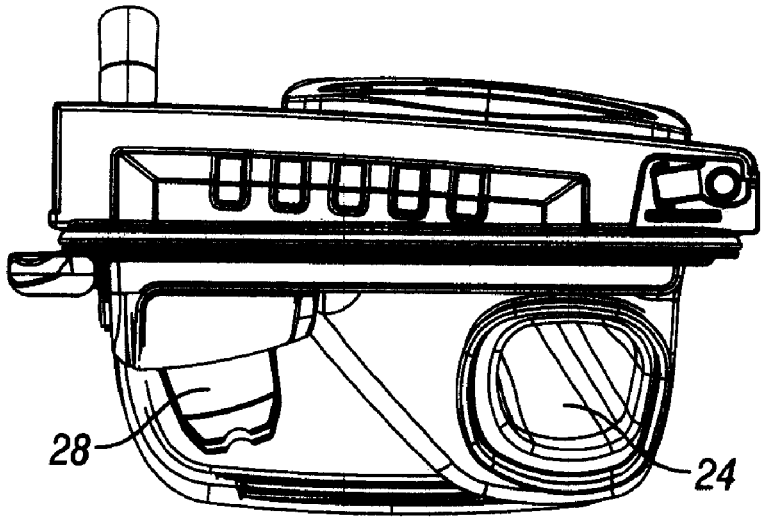
FIG. 11 is a top plan view of the door of FIGS. 2A and 2B.
Figure 12:
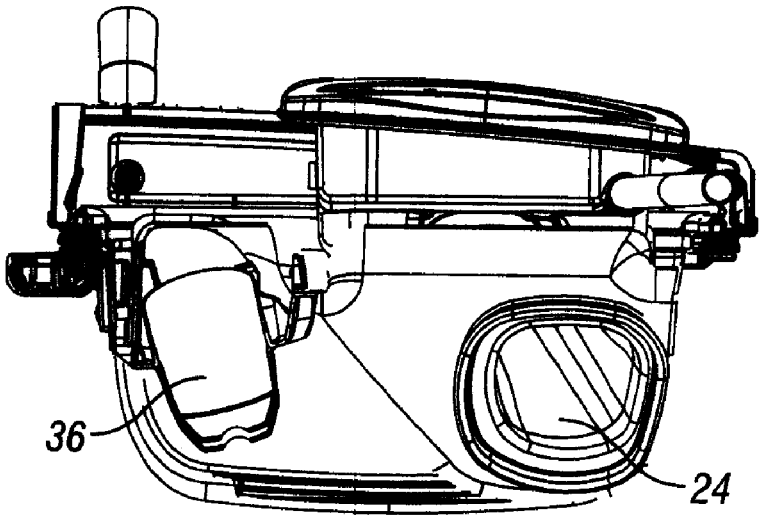
FIG. 12 is a sectional view taken along lines 12-12 of FIG. 3.

As best seen in FIGS. 4-8, each opening or cavity 30 includes a lower lip or cradle 36 adapted to engage a sidewall of the can, bottle, or container, so as to support the container in an inclined orientation. Thus, the container does not stand upright, as in other prior art door shelves or buckets. Cradle 36 extends both forwardly and rearwardly from the front wall 38 of the liner attachment 32. As seen in FIGS. 6-8, the cradle 36 is inclined slightly upwardly. As best seen in FIGS. 11 and 12, the cradle 36 is also angled inwardly toward the chute 24. Thus, the central axis of each opening 30 is oriented in a compound angle relative to the general plane of the door 16.

In use, the organizer 28 can hold most 12-16 oz bottles and cans, jars, yogurt cups, condiment containers, and other objects which are to be cooled by the fresh food compartment 12. The organizer 28 utilizes space in the door 16 that normally is wasted in prior art refrigerators.

It is understood that the organizer 28 of the present invention can be used on any refrigerator door, whether the refrigerator is a bottom mount, top mount, or side-by-side. Also, the organizer 28 can be used in refrigerator doors which do not have an ice and/or water dispenser.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A refrigerator, comprising:

a fresh food compartment;

at least one door for the fresh food compartment;

a plurality of openings formed in the door for holding individual containers in an inclined orientation; and a cradle on a lower portion of each opening to support a sidewall of the container.

2. The refrigerator of claim 1 further comprising a bottom mount freezer compartment.

3. The refrigerator of claim 2 further comprising an ice compartment remote from the freezer compartment.

4. The refrigerator of claim 1 further comprising an ice dispenser in the door.

5. The refrigerator of claim 1 wherein the openings are vertically aligned.

6. The refrigerator of claim 1 wherein each opening has a central axis oriented at a compound angle with respect to the plane of the door.

7. The refrigerator of claim 1 wherein each of the openings has a diameter slightly larger than the diameter of a 12 oz can of pop.

8. The refrigerator of claim 1 wherein the door includes an interior liner and the openings are formed in a component attached to the liner.

9. The refrigerator of claim 8 wherein the component has a front wall and the cradles extend forwardly and rearwardly from the front wall.

10. A refrigerator, comprising:

a fresh food compartment;

at least one door for the fresh food compartment; and a plurality of openings formed in the door for holding individual containers in an inclined orientation;

wherein the door includes an interior liner and the openings are formed in a component attached to the liner.

11. A refrigerator comprising:

a fresh food compartment;

a door for the fresh food compartment;

an ice chute and dispenser in the door; and a cavity adjacent the ice chute for holding a beverage or food container;

wherein the cavity includes a lower cradle to support a sidewall of the container.

12. A refrigerator comprising:

a fresh food compartment;

a door for the fresh food compartment;

an ice chute and dispenser in the door; and a cavity adjacent the ice chute for holding a beverage or food container;

wherein the door includes a primary liner and the cavity is formed in a secondary liner attached to the primary liner.

13. A refrigerator, comprising:

a fresh food compartment;

at least one door for the fresh food compartment;

a plurality of openings formed in the door for holding individual containers in an inclined orientation, the containers each having a bottom wall, a cylindrical sidewall with identifying indicia, and an upper end;

the openings each having a depth less than a length of the container sidewall, such that the indicia is visible when the container is stored in the opening; and a cradle on a lower portion of each opening to support a sidewall of the container.

14. A refrigerator, comprising:

a fresh food compartment;

at least one door for the fresh food compartment;

a plurality of openings formed in the door for holding individual containers in an inclined orientation, the containers each having a bottom wall, a cylindrical sidewall with identifying indicia, and an upper end;

the openings each having a depth less than a length of the container sidewall, such that the indicia is visible when the container is stored in the opening; and the door including an interior liner, and the openings are formed in a component attached to the liner.

15. The refrigerator of claim 14 further comprising a cradle on a lower portion of each opening to support a sidewall of the container.

* * * * *

UNITED STATES PATENT AND TRADEMARK OFFICE

CERTIFICATE OF CORRECTION

PATENT NO. : 7,610,774 B2
APPLICATION NO. : 11/331870
DATED : November 3, 2009
INVENTOR(S) : Anderson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 881 days.

Signed and Sealed this

Twelfth Day of October, 2010

David J. Kappos

David J. Kappos
*Director of the United States Patent and Trademark Office*